US005931373A

United States Patent [19]

Peleman

[11] Patent Number: 5,931,373

[45] Date of Patent: Aug. 3, 1999

[54] FILE FOLDER WITH CONNECTING SIDES PIECES

[75] Inventor: Guido Peleman, Puurs, Belgium

[73] Assignee: Unibind (Cyprus) Limited, Nicosia, Cyprus

[21] Appl. No.: 08/943,300

[22] Filed: Oct. 14, 1997

[30] Foreign Application Priority Data

Oct. 15, 1996 [BE] Belgium ..... 09600870

[51] Int. Cl.[6] ..... B65D 37/00

[52] U.S. Cl. ..... 229/122.24; 229/67.4; 220/690; 206/425

[58] Field of Search ..... 229/122.24, 122.21, 229/122.22, 122.23, 194, 67.1, 67.2, 67.3, 67.4; 206/308.1, 308.3, 425; 220/690, 691

[56] References Cited

U.S. PATENT DOCUMENTS

| | | | |
|---|---|---|---|
| 324,588 | 8/1885 | Powers | 229/198.2 |
| 761,181 | 5/1904 | Rich | 229/67.1 |
| 1,743,305 | 1/1930 | Banks | 229/67.3 X |
| 1,929,144 | 10/1933 | Kearney | 229/198.2 |
| 2,041,974 | 5/1936 | Sloan | 229/198.2 X |
| 3,675,807 | 7/1972 | Lund et al. | 220/690 X |
| 3,915,372 | 10/1975 | Crane | 229/122.22 |
| 4,211,358 | 7/1980 | Crane | 229/122.24 X |
| 4,482,074 | 11/1984 | Lalley | 229/122.24 X |
| 5,038,998 | 8/1991 | Morris et al. | 229/122.22 X |
| 5,497,939 | 3/1996 | Heiskell et al. | 229/198.2 X |
| 5,664,724 | 9/1997 | Ho | 229/67.4 |

FOREIGN PATENT DOCUMENTS

| | | | |
|---|---|---|---|
| 91 14 778 U | 4/1992 | Germany . | |
| 91 12 737 U | 6/1992 | Germany . | |
| 758012 | 9/1956 | United Kingdom . | |
| 1134859 | 8/1967 | United Kingdom | 220/690 X |
| 2 236 738 | 4/1991 | United Kingdom . | |

*Primary Examiner*—Stephen P. Garbe
*Assistant Examiner*—Tri M. Mai
*Attorney, Agent, or Firm*—Bacon & Thomas, PLLC

[57] ABSTRACT

A file folder includes a front sheet and a rear sheet made of a rigid material which are connected to each other by a flexible back. At least one of the sheets has an inwardly directed flap. Connecting pieces connected to side edges of the flap keep the flap spaced from the respective sheet to which the flap is attached, with the connecting pieces attached to the respective sheet and the flap by mechanical connections.

12 Claims, 3 Drawing Sheets

FILE FOLDER WITH CONNECTING SIDES PIECES

The present invention relates to a file, more particularly a file such as the ones used to collect bundles of loose documents or to collect periodicals and similar.

More particularly it concerns a file which is provided with an inwardly directed flap which at its side edges is kept by means of connecting pieces at a distance of the sheet to which the flap is attached.

With the known types of files the connecting pieces are glued to the edges of the flap and to the edges of the concerned sheet.

These known embodiments have a number of drawbacks. For instance, the assembly has to be done in the factory and in its finished shape the file occupies much space, whereby the latter is disadvantageous for the storage in the factory as well as with the user, as well as for the transport. Moreover each thickness requires another file, which requires a stock, composed of files of a different thickness.

The quality of the connection between the connecting pieces and the said edges can be difficulty controlled with the known embodiments, on account of the fact that the connections are realised with glue and such control is only possible in a destructive way, whereupon the file cannot be used anymore.

The present invention aims therefore at excluding the above-mentioned and other disadvantages of the known files. To this end the file according to the invention mainly consists of a front sheet and a rear sheet made of a rigid material which are connected with each other by a flexible back, and whereby at least one of the said sheets is provided with an inwardly directed flap which at its side edges is kept by means of connecting pieces at a distance of the sheet to which the flap is attached, whereby these connecting pieces are at least attached to the concerned sheet and the flap by mere mechanical connections.

In the most preferred embodiment these mechanical connections consist of mortise and tenon joints. Other connections, such as snap connections, are however not excluded.

It is clear that the file according to the invention obtains hereby the advantage that it can be assembled at the moment of its use, as a result of which the volume of the files which have to be put into store is considerably reduced.

With one file which has to be assembled, the connecting pieces of a different thickness can be supplied, in such a way that only one type of file has to be put into store instead of two or three types as was previously the case. The user can now determine himself which type of file he assembles, in other words he can choose himself the desired thickness.

In a preferred embodiment the said mortise and tenon joint will not only be provided, on the one hand, between the connecting pieces and, on the other hand, between the said sheet and the said flap, but likewise between the connecting piece and the flexible link between the flap and the sheet.

In order to better show the characteristics of the invention, a preferred embodiment according to the present invention is described hereafter, as an example, and without any restrictive character whatsoever, reference being made to the accompanying drawings, in which.

Figure 1:
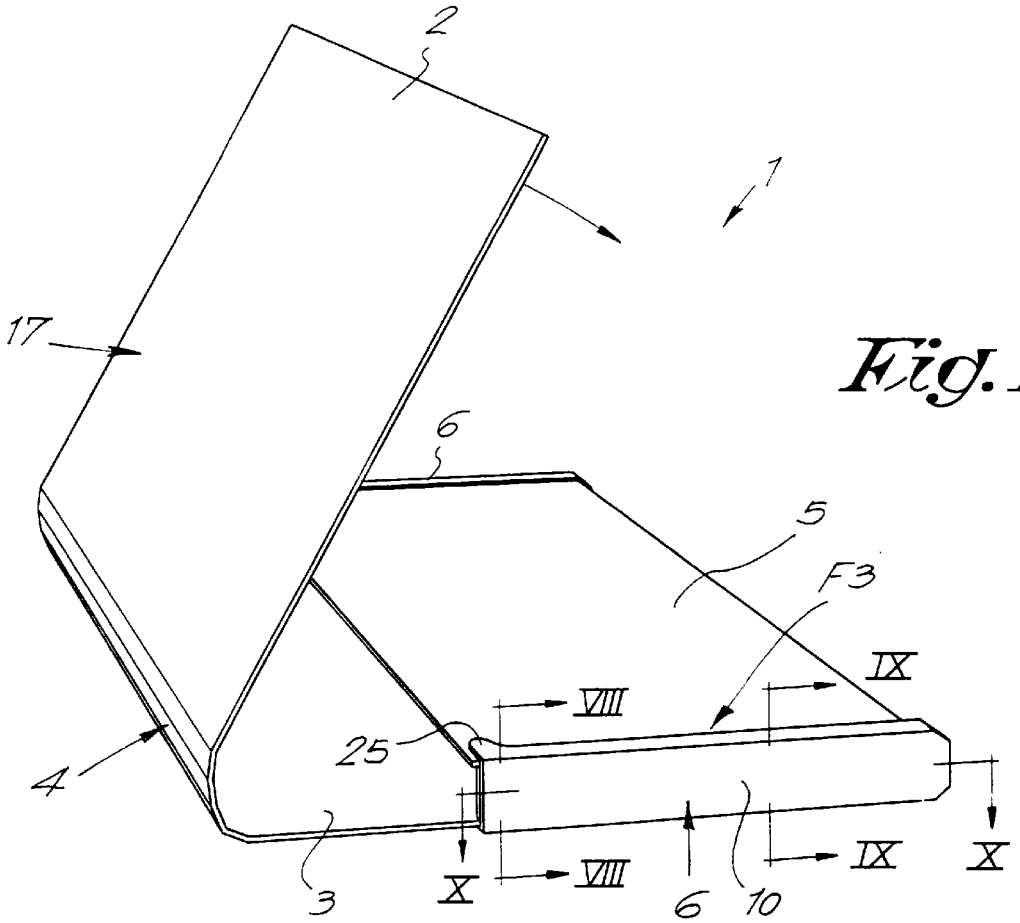
FIG. 1 represents a perspective view of a file according to the invention.

The file 1 according to the invention mainly consists, as represented in FIG. 1, of a front sheet 2 and a rear sheet 3 made of a rigid material which are connected with each other by a foldable back 4, whereby in this case the rear sheet 3 is elongated by a flap 5 which is folded back, which is kept at a distance of the sheet 3 by means of two connecting pieces 6.

Figure 2:
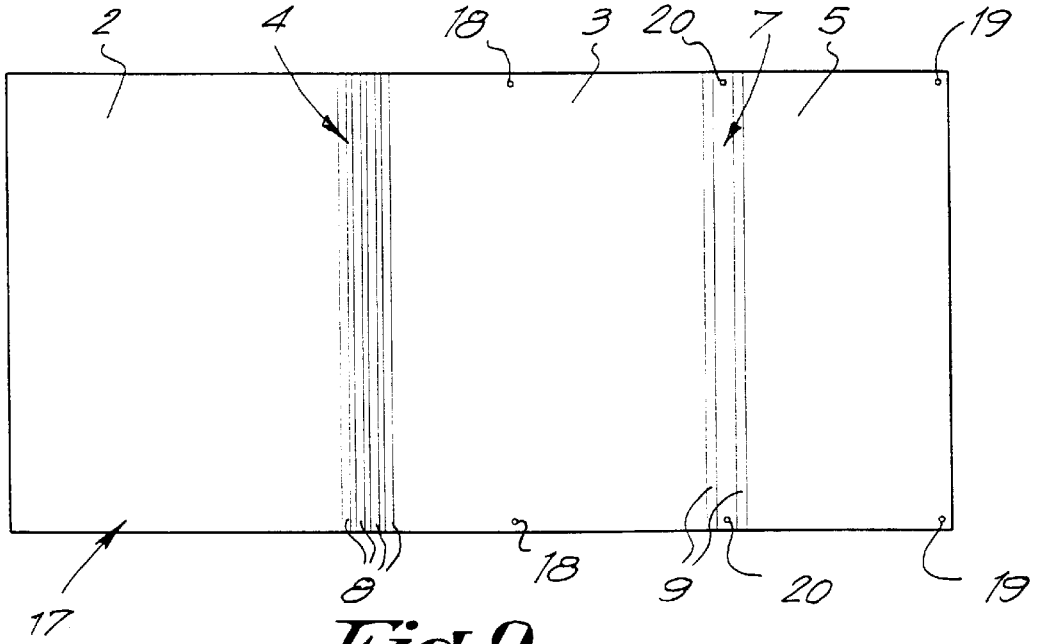
FIG. 2 represents a top view of an unfolding of the proper file according to FIG. 1.

The front sheet 2, the rear sheet 3, the back 4 and the flap 5 are preferably manufactured from a type of thick cardboard and can be provided with a covering or not, such as a smooth foil which sticks to the cardboard. As represented in FIG. 2 a number of folding lines 8–9 can be provided at the spot of the back 4 and the link 7 between the rear sheet 3 and the flap 5, for example in the shape of a thinning of the material, such as indentations.

As represented in FIGS. 3 to 7 each connecting piece 6 consists of a single piece made of synthetic material, which is mainly formed from an elongated wall part 10 and of inwardly directed edges 11-12-13 which are applied at three sides thereof, which are destined to form supports for the edges of the rear sheet 3, of the link 7 and of the flap 5.

Figure 9:
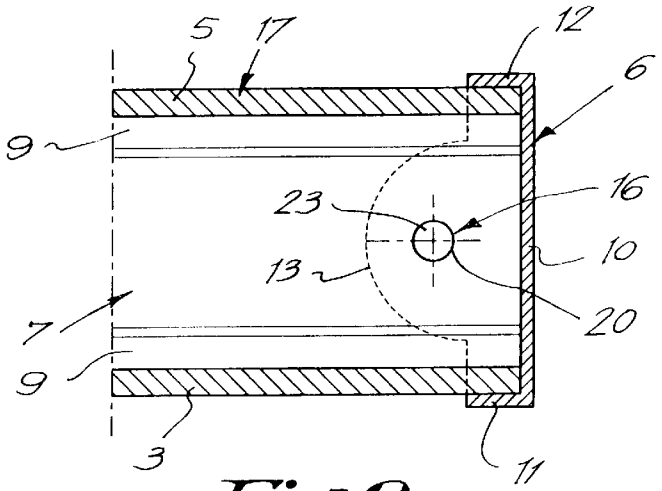
FIGS. 8 and 9 represent cross-sectional views at an enlarged scale, according to lines VIII—VIII and IX—IX, respectively, in FIG. 1, whereby these cross-sections are taken at the same spots as the ones of the FIGS. 4 and 5 in FIG. 3.
Figure 8:
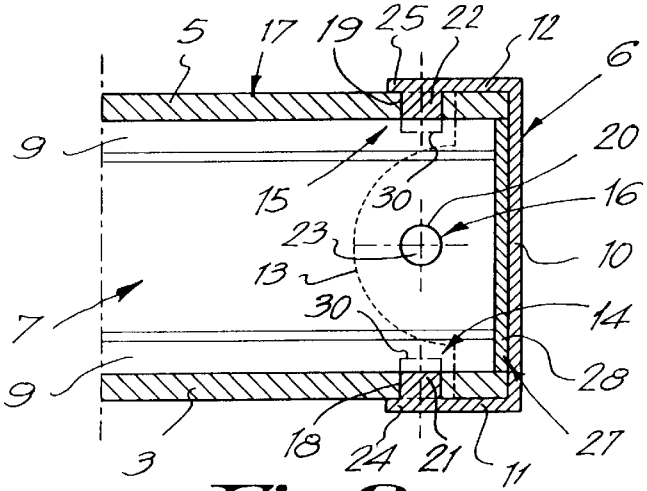
Figure 10:
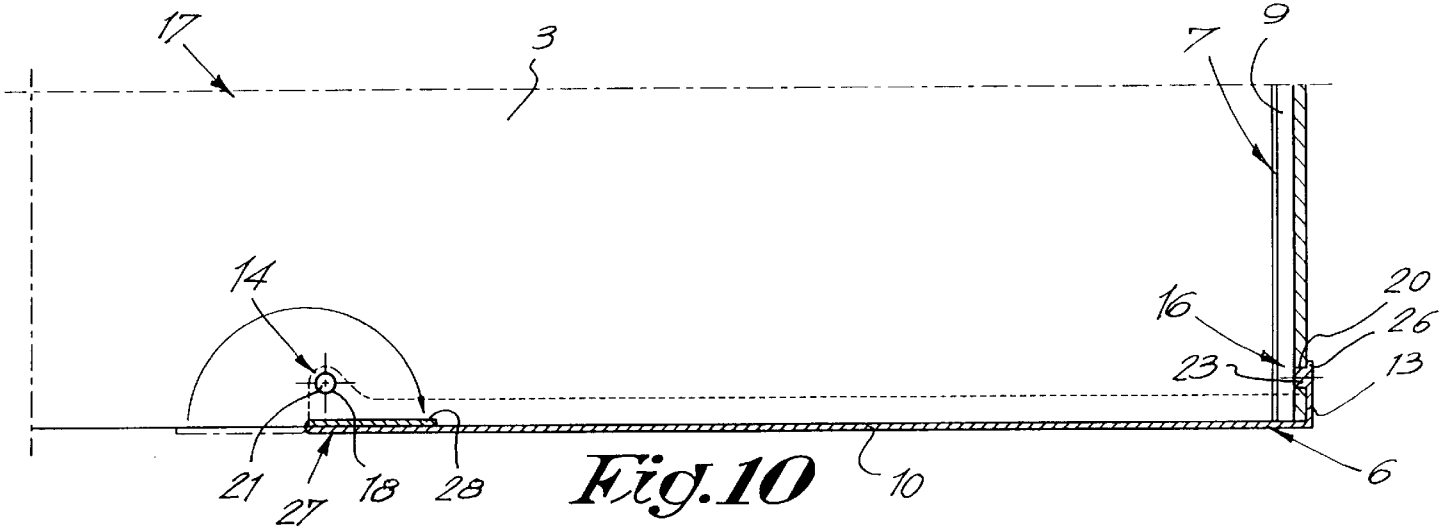
FIG. 10 represents a cross-sectional view according to line X—X in FIG. 1.

As represented in FIGS. 8 to 10 the connecting pieces 6 are attached to the proper file by means of mechanical connections, more particularly mortise and tenon joints, in this case three connections per each connecting piece 6, namely 14-15-16.

As represented in the example, the mortise and tenon joints are not only provided, on the one hand, between the connecting pieces 6 and, on the other hand, the rear sheet 3 and the said flap 5, but likewise between the connecting pieces 6 and the link 7. More particularly three mortise and tenon joints are provided at the spot of each connecting piece 6, two mortise and tenon joints 14-15 at the spot of the free extremities of the edges 11 and 12 and a third mortise and tenon joint 16 at the spot of the said edge 13, respectively.

With a view to realise these mortise and tenon joints 14-15-16, on the one hand, tenons 18-19-20 are applied in the proper file 17, as represented in FIG. 2. On the other hand, corresponding mortises 21-22-23 are applied to the connecting pieces 6, which form one part with these connecting pieces 6. The tenons 21-22-23 are situated at the inner side of the edges 11-12-13, preferably at the spot of the protruding lips 24-25-26 applied to that end.

The tenons 21-22-23 are preferably of a circular shape and show a length which corresponds with the thickness of the material from which the proper file 17 is made. The diameter of the tenons 21-22-23 preferably corresponds with the one of the mortises 18-19-20 or is even a little greater, in such a way that during the assembly a clamping effect is obtained.

Figures 3, 4, 5, 6, 7:
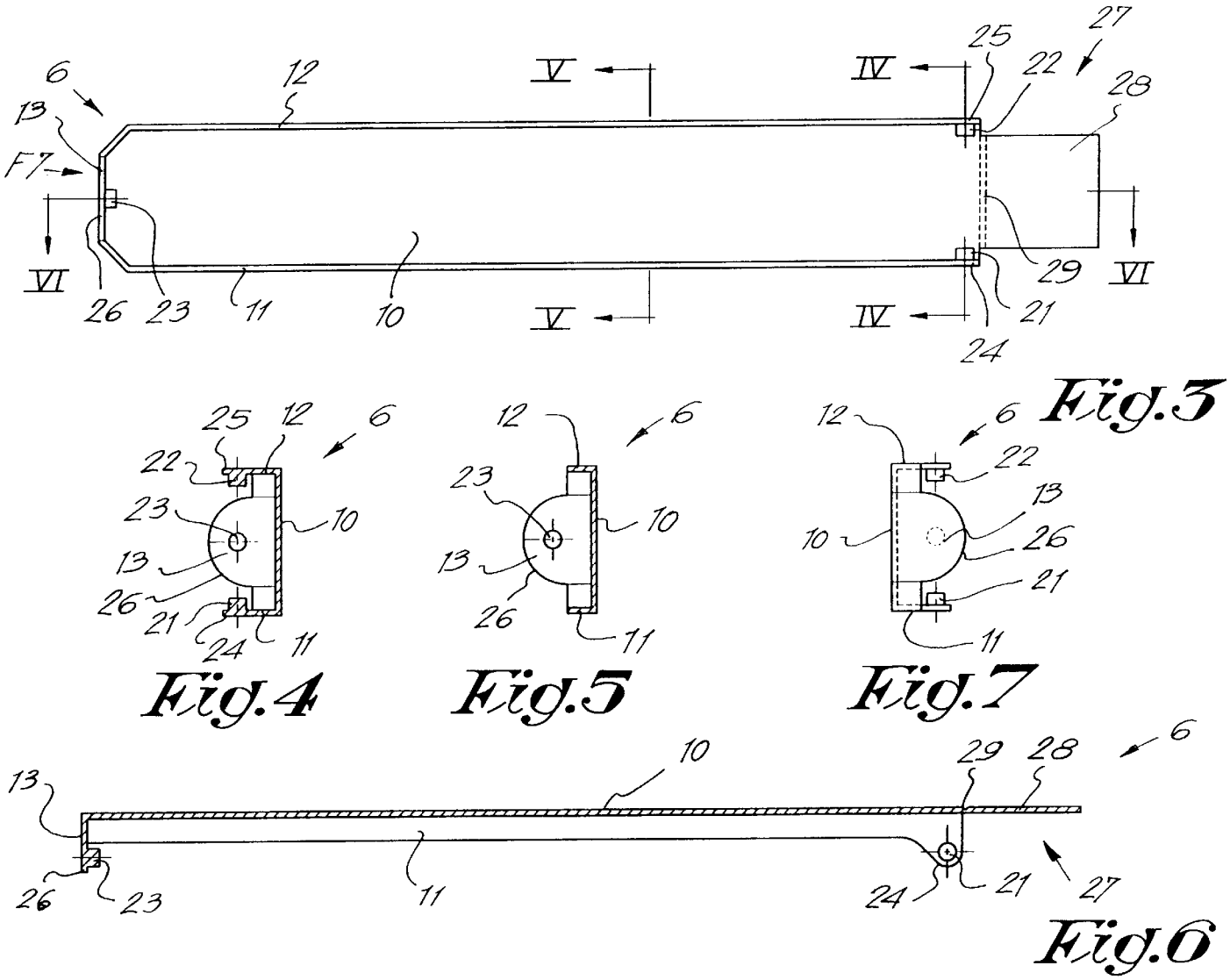
FIG. 3 represents a view of the inner side of the connecting piece which is indicated in FIG. 1 by F3.
FIGS. 4, 5 and 6 represent cross-sectional views, according to lines IV—IV, V—V and VI—VI, respectively, in FIG. 3.
FIG. 7 represents a view according to the arrow F7 in FIG. 3.

As is made clear in the FIGS. 3, 8 and 10, the file 1 can be provided with a lock 27 which prevents that the mortise and tenon joints 14-15-16 become loose. To this end parts 28 which can be folded inwardly are applied to the connecting pieces 6 which can place themselves between the concerned sheet, in this case the rear sheet 3, and the flap 5, in such a way that they cannot move anymore towards each other, and consequently they cannot become loose from the tenons 21-22. By the fact that the mortise and tenon joints 14-15 cannot be severed anymore, it is hereby also obtained that the connecting pieces 6 cannot slide away laterally with respect to the proper file 17, with as a result that also the mortise and tenon joints 16 cannot become loose anymore.

The parts 28 form one part with the connecting pieces 6 and are foldable at one edge by means of a weakening in the material 29.

As represented with axis 30 in FIG. 8, the tenons 21 and 22 can possibly be made longer than the thickness of the material of the proper file 17, with as a result that the part 28 can be clamped more or less behind the tenons 21-22 and consequently can rebound only a little or cannot rebound at all.

It is clear that according to a variant a flap 5 can also be present at the front sheet 2. It is also not excluded to attach a flap 5 to the front sheet 2 as well as to the rear sheet 3 by means of connecting pieces 6.

The assembly of the file 1 can simply be deduced from the figures. In the first instance the flap 5 must be brought completely inwardly till against the rear sheet 3. Subsequently the connecting pieces 6 are applied and firstly a mortise and tenon joint 16 is realised. Subsequently, by pushing the flap 5 and the rear sheet 3 away from each other the mortise and tenon joints 14-15 can be realised, whereupon the unit can be locked by means of the said parts 28.

It is observed that the tenons 21-22-23 can have several shapes. According to the invention they can also consist of local protuberances of the material. The said mortises 18-19-20 must neither be on-going mortises.

The present invention is in no way limited to the embodiment described above and represented in the drawings, but such file can be realised in different shapes and dimensions, without leaving the scope of the invention.

I claim:

1. A file folder, comprising:

a front sheet made of a rigid material having a first edge, a second edge and two side edges;

a rear sheet made of a rigid material having a first edge, a second edge and two side edges;

a back section flexibly connecting said front sheet and said rear sheet to each other at said first edges;

an inwardly directed flap made of a rigid material connected to at least one of said sheets at said second edges; and connecting side pieces which connect said flap to said at least one of said sheets at said side edges such that said flap is kept spaced at a distance from said at least one of said sheets, said connecting side pieces being attached to said flap and said at least one of said sheets by mechanical connections, said mechanical connections comprising a plurality of mortise and tenon joints, said mortise and tenon points comprising a plurality of mortises formed in said flap and in said at least one of said sheets and a corresponding plurality of tenons integrally formed with said connecting side pieces;

wherein said connecting side pieces each comprise an elongated wall having inwardly directed edges with protruding lips situated in the plane of said inwardly directed edges and wherein said mechanical connections are located on at least one inner side of said inwardly directed edges and said plurality of tenons are located on an inner side of said protruding lips.

2. A file folder, comprising:

a front sheet made of a rigid material having a first edge, a second edge and two side edges;

a rear sheet made of a rigid material having a first edge, a second edge and two side edges;

a back section flexibly connecting said front sheet and said rear sheet to each other at said first edges;

an inwardly directed flap made of a rigid material connected to at least one of said sheets at said second edges; and connecting side pieces which connect said flap to said at least one of said sheets at said side edges such that said flap is kept spaced at a distance from said at least one of said sheets, said connecting side pieces each comprising an elongated wall having inwardly directed edges, said connecting side pieces being attached to said flap and said at least one of said sheets by mechanical connections, said mechanical connections comprising a plurality of mortise and tenon points located on at least one inner side of said inwardly directed edges, said plurality of mortise and tenon joints comprising a plurality of tenons and a corresponding plurality of mortises, said plurality of tenons being of a length that corresponds with the thickness of said rigid material of which said sheets and said flap are made.

3. A file folder, comprising:

a front sheet made of a rigid material having a first edge, a second edge and two side edges;

a rear sheet made of a rigid material having a first edge, a second edge and two side edges;

a back section flexibly connecting said front sheet and said rear sheet to each other at said first edges;

an inwardly directed flap made of a rigid material connected to at least one of said sheets at said second edges;

connecting side pieces which connect said flap to said at least one of said sheets at said side edges such that said flap is kept spaced at a distance from said at least one of said sheets, said connecting side pieces each comprising an elongated wall having inwardly directed edges, said connecting side pieces being attached to said flap and said at least one of said sheets by mechanical connections, said mechanical connections comprising a plurality of mortise and tenon points located on at least one inner side of said inwardly directed edges; and a fold panel located between said flap and said at least one of said sheets, wherein said plurality of mortise and tenon joints are provided between each of said connecting side pieces and said at least one of said sheets, said flap, and said fold panel.

4. A file folder according to claim 3, wherein said mortise and tenon joints comprise a plurality of mortises formed in said flap and in said at least one of said sheets and a corresponding plurality of tenons integrally formed with said connecting side pieces.

5. A file folder according to claim 4, wherein said plurality of tenons are located on said a least one inner side of said inwardly directed edges.

6. A file folder according to claim 5, wherein said inwardly directed edges have protruding lips situated in the plane of said inwardly directed edges and said plurality of tenons are located on an inner side of said protruding lips instead of said inwardly directed edges.

7. A file folder according to claim 6, wherein said plurality of mortise and tenon joints comprises exactly three mortise and tenon joints, a first and a second of said three joints being respectively located near a free extremity of said inwardly directed edges such that said first and second joints cooperate with said flap and said at least one of said sheets, a third of said three joints being located at said inwardly directed edge between said flap and said at least one of said sheets such that said third joint cooperates with said fold panel.

8. A file folder according to claim 7, further comprising: locks which prevent said plurality of mortise and tenon joints from becoming loose.

9. A file folder according to claim 8, wherein said locks comprise folding parts attached to said connecting side pieces such that said parts keep said flap and said at least one of said sheets separated when said parts are folded inwardly between said flap and said at least one said sheets.

10. A file folder according to claim 3, wherein said plurality of mortise and tenon joints comprises a plurality of tenons and a corresponding plurality of mortises, said plurality of tenons exactly fitting said corresponding plurality of mortises.

11. A file folder according to claim 3, wherein said plurality of mortise and tenon joints comprises a plurality of tenons and a corresponding plurality of mortises, said plurality of tenons fitting said corresponding plurality of mortises such that a clamping effect is obtained.

12. A file folder according to claim 3, wherein said plurality of mortise and tenon joints comprises a plurality of tenons and a corresponding plurality of mortises, said plurality of tenons being of a length that corresponds with the thickness of said rigid material of which said sheets and said flap are made.

* * * * *